US006537394B1

(12) United States Patent
Osawa et al.

(10) Patent No.: US 6,537,394 B1
(45) Date of Patent: Mar. 25, 2003

(54) METHOD FOR PRODUCING HOT-DIP GALVANIZED STEEL SHEET HAVING HIGH STRENGTH AND ALSO BEING EXCELLENT IN FORMABILITY AND GALVANIZING PROPERTY

(75) Inventors: Kazunori Osawa, Okayama (JP); Kei Sakata, Okayama (JP); Osamu Furukimi, Chiba (JP); Yoshitsugu Suzuki, Okayama (JP); Akio Shinohara, Tokyo (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/868,674

(22) PCT Filed: Oct. 13, 2000

(86) PCT No.: PCT/JP00/07115

§ 371 (c)(1),
(2), (4) Date: Jun. 21, 2001

(87) PCT Pub. No.: WO01/31077

PCT Pub. Date: May 3, 2001

(30) Foreign Application Priority Data

Oct. 22, 1999 (JP) ..... 11-300739
Jul. 12, 2000 (JP) ..... 2000-211028

(51) Int. Cl.[7] ..... C12D 8/00
(52) U.S. Cl. ..... 148/533; 148/602; 148/603
(58) Field of Search ..... 148/533, 602, 148/603, 320; 428/659

(56) References Cited

U.S. PATENT DOCUMENTS 5,180,449 A * 1/1993 Masui et al. ..... 148/533

FOREIGN PATENT DOCUMENTS

| | | |
|---|---|---|
| JP | 5-106007 | 4/1993 |
| JP | 5-112830 | 5/1993 |
| JP | 10-183252 | 7/1998 |
| JP | 11-323443 | 11/1999 |

* cited by examiner

*Primary Examiner*—Deborah Yee
(74) *Attorney, Agent, or Firm*—Young & Thompson

(57) ABSTRACT

A hot-dip galvanized high-strength steel sheet having superior workability and galvanizability containing:

0.01% to 0.20% by weight of C;
1.0% by weight or less of Si;
more than 1.5% to 3.0% by weight of Mn;
0.10% by weight or less of P;
0.05% by weight or less of S;
0.10% by weight or less of Al;
0.010% by weight or less of N;
0.010% to 1.0% by weight in total of at least one element selected from the group consisting of Ti, Nb, and V; and
the balance being Fe and incidental impurities;

in which the steel sheet has the metal structure in which the areal rate of the ferrite phase is 50% or more, the ferrite phase has an average grain diameter of 10 $\mu$m or less, and the thickness of a band-like structure composed of the second phase satisfies the relationship $Tb/T \leqq 0.005$, where Tb is the average thickness in the sheet thickness direction of the band-like structure and T is the thickness of the steel sheet, and a method for producing the same. To provide a method for producing a hot-dip galvanized high-strength steel sheet in which superior workability and high strength are obtained and moreover satisfactory galvanizability is obtained when galvanizing is performed using facilities such as a continuous galvanizing line.

4 Claims, 2 Drawing Sheets

METHOD FOR PRODUCING HOT-DIP GALVANIZED STEEL SHEET HAVING HIGH STRENGTH AND ALSO BEING EXCELLENT IN FORMABILITY AND GALVANIZING PROPERTY

TECHNICAL FIELD

The present invention relates to a method for producing hot-dip galvanized high-strength steel sheets (including hot-dip galvannealed high-strength steel sheets) which are suitable for use as automotive inner panels, outer panels, etc.

BACKGROUND ART

Recently, in view of safety, weight reduction, and improved gas mileage in automobiles, and also in view of improvement in the global environment, there is a growing tendency to use hot-dip galvanized high-strength steel sheets as automotive steel sheets.

In order to produce a hot-dip galvanized high-strength steel sheet, the steel sheet must have superior galvanizability and must have the desired strength and workability after the steel sheet passes through a molten zinc bath, or after the steel sheet is further subjected to galvannealing.

In general, in order to increase the strength of a steel sheet, solid solution hardening elements, such as Mn, Si, and P, and precipitation hardening elements, such as Ti, Nb, and V, are added thereto. It is known that when a steel sheet to which such elements have been added is treated in a continuous galvanizing line (CGL), galvanizability is deteriorated.

Since the amounts of the alloying elements inversely affect the strength and the galvanizability, it has been extremely difficult to produce a hot-dip galvanized high-strength steel sheet having superior galvanizability in the continuous galvanizing line. Additionally, since the hot-dip galvanized high-strength steel sheet generally has inferior characteristics regarding workability, such as in elongation, it has been more difficult to produce a hot-dip galvanized steel sheet having superior workability.

As a conventional high-strength steel sheet having improved workability, a steel sheet with a complex structure, in which a ferrite matrix contains a low-temperature transformed phase having martensite as a principal phase (also including retained austenite), is known. The steel sheet with this complex structure has non-aging properties at room temperature and a low yield ratio, and has superior workability and superior bake hardenability after working. The steel sheet with a complex structure is produced by heating at temperatures in the ferrite and austenite ($\alpha+\gamma$) two-phase region, followed by quenching by water-cooling, gas-cooling, or the like.

However, when the steel sheet with a complex structure is galvanized at a temperature of approximately 500° C., or is further galvannealed, martensite distributed in the ferrite matrix is tempered, tensile strength and elongation are decreased, and the upper yielding point appears, resulting in an increase in yield ratio, and also yield point elongation occurs.

Temper softening easily occurs as the amounts of alloying elements, such as Mn and Si, are decreased. On the other hand, when the amounts of such alloying elements are increased, hot-dip galvanizability is decreased. Ultimately, in the steel sheet with a complex structure, since martensite is tempered in the galvanizing process, it has been difficult to make workability and high strength, which are characteristics thereof, compatible with each other and also to develop satisfactory galvanizability, using the conventional techniques.

Accordingly, the applicant of the present invention has applied for other patents under International Application Nos. PCT/JP99/04385 and PCT/JP00/02547 for inventions relating to high-strength steel sheets having satisfactory galvanizability and methods for producing the same.

PCT/JP99/04385 is an invention relating to a high-strength steel sheet to which Mo and Cr have been added, which are significantly important in producing a dual-phase galvanized steel sheet with a complex structure in which the matrix ferrite contains the low-temperature transformed phase having martensite as the principal phase. However, Mo and Cr are very expensive elements and are constituents which are too costly for the production of general-purpose, inexpensive galvanized steel sheet to which the present invention is directed. Additionally, in PCT/JP99/04385, although Mo is added to the material containing a large amount of Mn in order to produce a more favorably dual-phase sheet steel with a complex structure, if Mo is added, the thickness of a band-like structure in the steel sheet is increased. Consequently, press cracking may occur, resulting in deterioration in workability, and in order to eliminate the band-like structure, high-temperature annealing is absolutely necessary. Although the high-temperature heating is effective for galvanizability when double heating is performed, the high-temperature heating acts adversely when single heating is performed, and thus it is not necessarily a condition suitable for to reconciling the two processes.

On the other hand, PCT/JP00/02547 relates to a galvanized steel sheet with a complex structure to which 1.0% to 3.0% of Mn and 0.3% to 1.8% of Si are added, and which contains the retained austenite phase and the tempered martensite phase which are very important in improving the strength-elongation balance. However, in order to obtain such a structure, a primary heating-cooling process and a secondary heating-cooling process must be combined. Additionally, in the cooling step after heating is performed in the primary process, quenching treatment must be performed rapidly at a cooling rate of 10° C./s or more, down to the Ms temperature or less, resulting in processing difficulties. Also, in addition to a single heating-cooling process which is normally performed, at least one other heating-cooling process must be performed before the CGL line.

DISCLOSURE OF INVENTION

Accordingly, in order to overcome the problems associated with the conventional techniques described above, it is an object of the present invention to provide a method for producing a hot-dip galvanized high-strength steel sheet in which both satisfactory workability and high strength are provided, and moreover satisfactory galvanizability is obtained even if galvanizing is performed using facilities such as a continuous galvanizing line.

Specifically, it is an object of the present invention to obtain satisfactory galvanization while satisfying a TS of 590 MPa or more, an El of 25% or more, and a value of TS×El of 15,000 MPa.% or more, as standards for workability and high strength.

In this case, the present inventors have made every effort to carry out research to solve the problems described above and have discovered a hot-dip galvanized high-strength steel sheet having superior workability and galvanizability even if Mo and Cr are not added, and even if the retained austenite phase and the tempered martensite phase are not contained, as well as a method for producing the same, thus achieving the present invention.

(1) A hot-dip galvanized high-strength steel sheet having superior workability and galvanizability contains, in % by weight, 0.01% to 0.20% of C, 1.0% or less of Si, more than 1.5% to 3.0% of Mn, 0.10% or less of P, 0.05% or less of S, 0.10% or less of Al, and 0.010% or less of N, and also contains 0.010% to 1.0% in total of at least one element selected from the group consisting of Ti, Nb, and V, and the balance being Fe and incidental impurities, and also has the metal structure in which the areal rate of the ferrite phase is 50% or more, the ferrite phase has an average grain diameter of 10 $\mu$m or less, and the thickness of a band-like structure composed of the second phase satisfies the relationship $Tb/T \leqq 0.005$, where Tb is the average thickness in the sheet thickness direction of the band-like structure and T is the thickness of the steel sheet.

(2) A hot-dip galvanized high-strength steel sheet having superior workability and galvanizability contains, in % by weight, 0.01% to 0.20% of C, 1.0% or less of Si, more than 1.5% to 3.0% of Mn, 0.10% or less of P, 0.05% or less of S, 0.10% or less of Al, and 0.010% or less of N, and also contains 0.010% to 1.0% in total of at least one element selected from the group consisting of Ti, Nb, and V, and further contains 3.0% or less in total of at least one of Cu and Ni, and the balance being Fe and incidental impurities, and also has the metal structure in which the areal rate of the ferrite phase is 50% or more, the ferrite phase has an average grain diameter of 10 $\mu$m or less, and the thickness of a band-like structure composed of the second phase satisfies the relationship $Tb/T \leqq 0.005$, where Tb is the average thickness in the sheet thickness direction of the band-like structure and T is the thickness of the steel sheet.

(3) A method for producing a hot-dip galvanized high-strength steel sheet having superior workability and galvanizability includes the steps of hot-rolling a slab having the steel composition described in (1) or (2) above, followed by coiling at 750 to 450° C.; optionally, further performing cold-rolling; heating the resulting hot-rolled sheet or cold-rolled sheet to a temperature of 750° C. or more; and subjecting the hot-rolled sheet or cold-rolled sheet to hot-dip galvanizing while cooling from this temperature.

(4) A method for producing a hot-dip galvanized high-strength steel sheet having superior workability and galvanizability includes the steps of hot-rolling a slab having the steel composition described in (1) or (2) above, followed by coiling at 750 to 450° C.; optionally, further performing cold-rolling; heating the resulting hot-rolled sheet or cold-rolled sheet to a temperature of 750° C. or more; subjecting the hot-rolled sheet or cold-rolled sheet to hot-dip galvanizing while cooling from this temperature; and then performing galvannealing.

(5) A method for producing a hot-dip galvanized high-strength steel sheet having superior workability and galvanizability includes the steps of hot-rolling a slab having the steel composition described in (1) or (2) above, followed by coiling at 750 to 450° C.; optionally, further performing cold-rolling; heating the resulting hot-rolled sheet or cold-rolled sheet to 750° C. or more, followed by cooling; further heating to a temperature of 700° C. or more; and subjecting the hot-rolled sheet or cold-rolled sheet to hot-dip galvanizing while cooling from this temperature.

(6) A method for producing a hot-dip galvanized high-strength steel sheet having superior workability and galvanizability includes the steps of hot-rolling a slab having the steel composition described in (1) or (2) above, followed by coiling at 750 to 450° C.; optionally, further performing cold-rolling; heating the resulting hot-rolled sheet or cold-rolled sheet to 750° C. or more, followed by cooling; further heating to a temperature of 700° C. or more; subjecting the hot-rolled sheet or cold-rolled sheet to hot-dip galvanizing while cooling from this temperature; and then performing galvannealing.

That is, this may be accomplished by:

(1) positively adding at least one element selected from the group consisting of Ti, Nb, and V, it is possible to refine ferrite ($\alpha$) grains to 10 $\mu$m or less due to pinning of the grain boundary migration of carbides, such as TiC, NbC, and VC, and also it is possible to suppress the coarsening of $\gamma$ gains generated and grown in the ferrite and austenite ($\alpha+\gamma$) two-phase region during heating or $\gamma$ gains in the austenite ($\gamma$) single-phase region;

(2) heating, the band-like structure composed of the second phase containing large amounts of C and Mn is dissolved so that the thickness of the band-like structure satisfies the relationship $Tb/T \leqq 0.005$, where Tb is the average thickness in the sheet thickness direction of the band-like structure and T is the thickness of the steel sheet.

Because of synergy between (1) and (2) described above, even without adding Mo and Cr, and also even if the structure does not contain the retained austenite phase and the tempered martensite phase, since the $\gamma$ grains before cooling are refined, the concentration of C and Mn from the $\alpha$ phase to the $\gamma$ phase during cooling is increased, the $\gamma$ phase is effectively transformed into martensite, and thus a hot-dip galvanized high-strength steel sheet having superior workability and galvanizability can be produced.

In particular, in contrast to PCT/JP99/04385 and PCT/JP00/02547, since Cr and Si, which are disadvantageous to galvanizability, are not substantially contained as essential elements, satisfactory galvanizability is obtained, and since Mo is not added, the band-like structure which is present before heating is relatively thin, and thus, even if high-temperature heating, which is disadvantageous in view of galvanizability, is not performed in the single CGL process, it is possible to produce a hot-dip galvanized high-strength steel sheet having superior workability.

BEST MODE FOR CARRYING OUT THE INVENTION

First, experimental results on which the present invention is based will be described.

EXPERIMENT 1

A sheet bar having a thickness of 30 mm and the chemical composition including 0.08% by weight of C, 0.01% by weight of Si, 1.9% by weight of Mn, 0.011% by weight of P, 0.002% by weight of S, 0.04% by weight of Al, 0.0022% by weight of N, 0.02% by weight of Ti, and 0.05% by weight of Nb was heated to 1,200° C. and rolled by a 5-pass hot rolling to produce a hot-rolled sheet with a thickness of 2.8 mm. Next, heat treatment was performed for 1 hour at 400° C. or 650° C., which corresponded to treatment at a coiling temperature (CT). Pickling treatment was then performed, followed by cold rolling to produce a cold-rolled sheet with a thickness of 1.4 mm, which was held while being heated at 700° C. to 850° C. for 1 minute, and was cooled to 500° C. at a rate of 10° C./s. Galvanizing was performed, followed by holding for 40 s, and galvannealing was performed by heating to 550° C. at a rate of 10° C./s, immediately followed by cooling to room temperature at a rate of 10° C./s. Temper rolling was then performed with a rolling reduction of 1.0%.

With respect to the resulting hot-dip galvanized steel sheet, tensile characteristics (TS, YS, and El) were measured using JIS No. 5 test pieces for tensile testing, and galvanizability was also investigated.

In order to evaluate the galvanizability, the surfaces were visually inspected, using the following criteria.

○: No non-galvanized defects (good galvanizability)

Δ: Non-galvanized defects occurred in some parts (partially good galvanizability)

x: Non-galvanized defects occurred over the entire surface (bad galvanizability)

Figure 1:
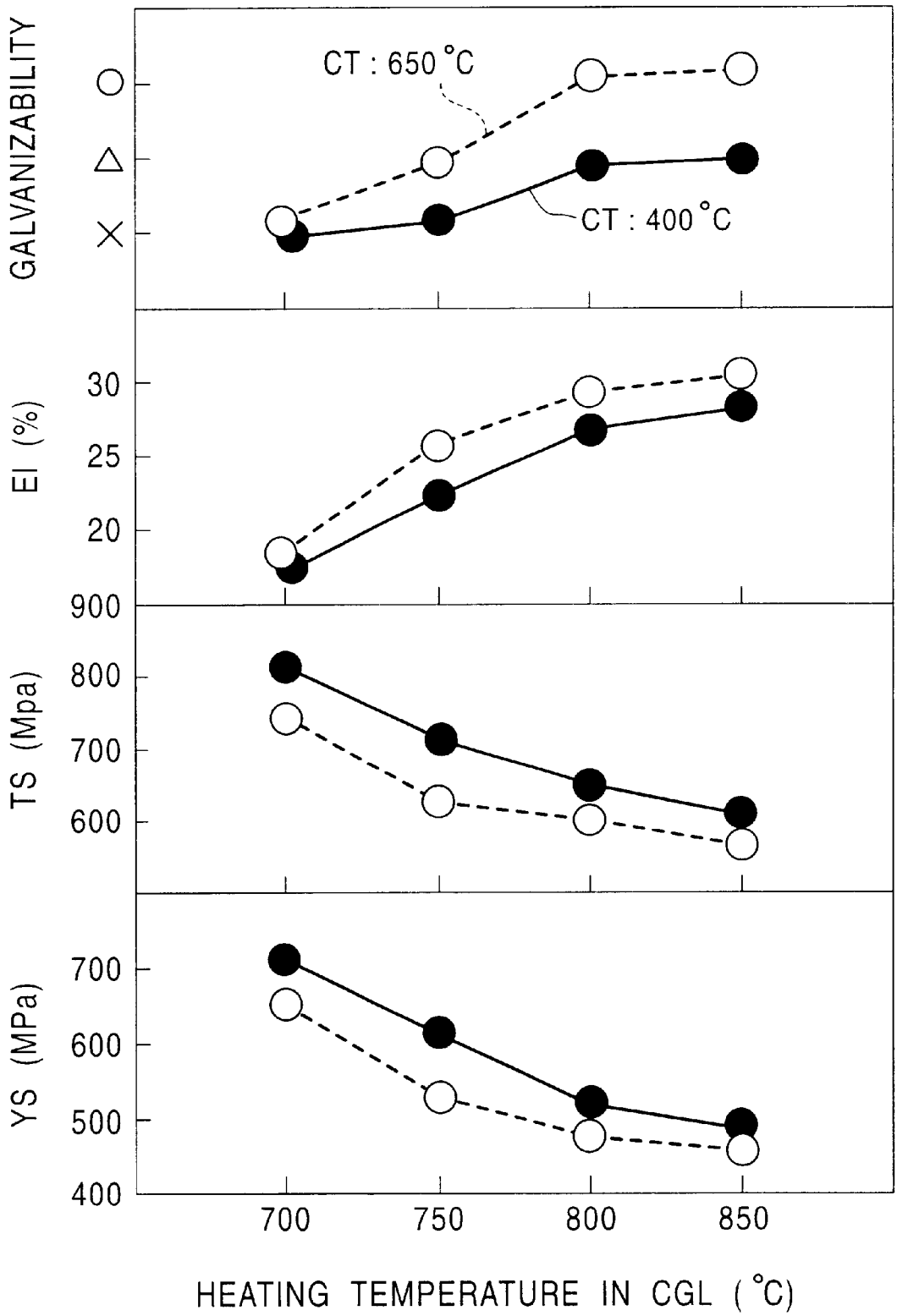
FIG. 1 is a graph which shows the relationships between the heating temperature in a continuous galvanizing line and the tensile strength (TS), the yield strength (YS), the elongation (El), and galvanizability.

The results obtained are shown in FIG. 1. As is clear from FIG. 1, when the coiling temperature is 650° C. and heating temperature before galvanizing is 750° C. or more, a TS of 590 MPa or more and an El of 25% or more can be achieved.

EXPERIMENT 2

A cold-rolled sheet with a thickness of 1.6 mm having the same composition as that in Experiment 1, in which the heat treatment temperature corresponding to CT was varied from 400° C. to 700° C., was held at 750° C. for 1 minute (first heating), followed by cooling to room temperature at a rate of 10° C./s, and pickling treatment was then performed, followed by holding at 750° C. for 1 minute (second heating) and cooling to 500° C. at a rate of 10° C./s. Galvanizing was performed, followed by holding for 40 s, and galvannealing was performed by heating to 550° C. at a rate of 10° C./s, immediately followed by cooling to room temperature at a rate of 10° C./s. Temper rolling was then performed with a rolling reduction of 1.0%.

Figure 2:
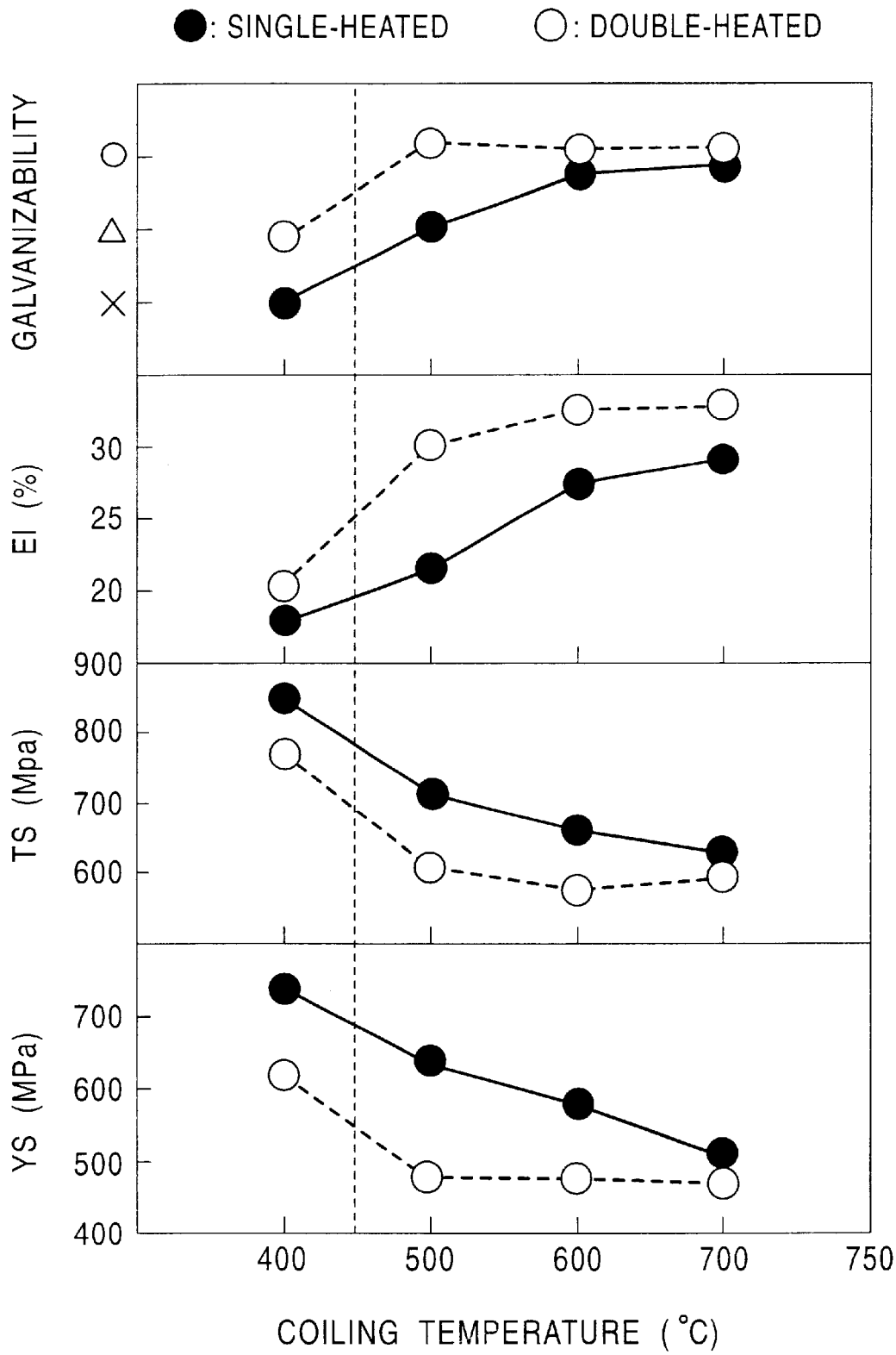
FIG. 2 is a graph which shows the relationships between the coiling temperature and the tensile strength (TS), the yield strength (YS), the elongation (El), and galvanizability, and also shows the influence when double heating is performed.

With respect to the resulting hot-dip galvanized steel sheet, tensile characteristics and galvanizability were investigated in a manner similar to that in Experiment 1. As a result, it was found that when double heating treatment (first heating and second heating) is performed (indicated by ○ in FIG. 2), as shown in FIG. 2, both tensile characteristics and galvanizability could be further improved in comparison with an experiment that is similar to Experiment 1 in which single heating only is performed (indicated by ● in FIG. 2).

As is clear from each of the experiments described above, even when the strength of a steel sheet is increased by increasing the Mn content, galvanizability and mechanical characteristics can be improved by high-temperature coiling, heating at high temperatures before galvanizing, or double heating treatment.

The reasons for such effects are believed to be that in high-temperature coiling and double heating treatment, an internal oxidation layer for elements which are easily oxidized is generated just below the surface of the steel sheet, and thus Mn, which is disadvantageous to galvanizability, is prevented from concentrating in the surface of the steel sheet, and a concentrated surface layer of Mn, which is disadvantageous to galvanizability, which is generated by high-temperature heating, is removed by pickling treatment before the second heating, and that in high-temperature heating prior to galvanizing, the band structure with high concentrations of C and Mn is dissolved, which favorably affects the generation of the second phase, such as martensite.

Next, the reasons for specifying the limits in compositions and production conditions in the present invention will be described. (The compositions are shown in percent by mass.)

C: 0.01% to 0.20% by weight

Carbon is one of the important, basic elements constituting a steel, and in particular, in the present invention, carbon precipitates carbides of Ti, Nb, and V, thus increasing strength, and also improves strength via the bainite phase and the martensite phase which are generated at low temperatures. If the carbon content is less than 0.01% by weight, the precipitates, as well as the bainite phase and the martensite phase, are not easily generated. If the carbon content exceeds 0.20% by weight, spot weldability is decreased. Therefore, the carbon content is set in the range of 0.01% to 0.20% by weight. Additionally, the carbon content is preferably set at 0.03% to 0.15% by weight.

Si: 1.0% by weight or less

Although silicon is an element which improves workability, such as elongation, by decreasing the amount of a solid solution of carbon in the α phase, if the silicon content exceeds 1.0% by weight, spot weldability and galvanizability are decreased, and thus the upper limit is set at 1.0% by weight. Additionally, the silicon content is preferably set at 0.5% by weight or less. Since it is expensive to limit the silicon content to less than 0.005% by weight, preferably, the lower limit is set at 0.005% by weight.

Mn: more than 1.5% to 3.0% by weight

Manganese is one of the important components in the present invention; it is an element which suppresses the transformation in the complex structure and stabilizes the γ phase. However, if the manganese content is 1.5% by weight or less, the effect thereof is not exhibited, and if the manganese content exceeds 3.0% by weight, spot weldability and galvanizability are significantly impaired. Therefore, manganese is added in the range of more than 1.5% to 3.0% by weight, and preferably, in the range of 1.6% to 2.5% by weight.

P: 0.10% by weight or less

Although phosphorus is an effective element to achieve high strength inexpensively, if the phosphorus content exceeds 0.1% by weight, spot weldability is significantly decreased, and thus the upper limit is set at 0.10% by weight. Additionally, the phosphorus content is preferably limited to 0.05% by weight or less. Since it is expensive to limit the phosphorus content to less than 0.001% by weight, the lower limit is preferably set at 0.001% by weight.

S: 0.05% by weight or less

Sulfur causes red shortness during hot rolling and induces cracking in nuggets in the spot-welded zone, and thus the sulfur content is preferably decreased as much as possible. Therefore, in the present invention, the upper limit is set at 0.05% by weight or less. Additionally, the sulfur content is more preferably limited to 0.010% by weight or less. Since it is expensive to limit the sulfur content to less than 0.0005% by weight, the lower limit is preferably set at 0.0005% by weight.

Al: 0.10% by weight or less

Aluminum is an element which acts as a deoxidizing agent in the steel making process and which is effective in pinning N, which causes strain aging, as AlN. However, since the aluminum content exceeding 0.10% by weight results in an increase in production costs, the aluminum content must be limited to 0.10% by weight or less. Additionally, the aluminum content is preferably set at 0.050% by weight. If the aluminum content is less than 0.005% by weight, sufficient deoxidation cannot be performed, and thus the lower limit is preferably set at 0.005% by weight.

N: 0.010% by weight or less

Since nitrogen causes strain aging, increases the yield point (yield ratio), and causes yield elongation, the nitrogen content must be limited to 0.010% by weight or less. Additionally, the nitrogen content is preferably set at 0.0050% by weight or less. Since it is expensive to limit the nitrogen content to less than 0.0005% by weight, the lower limit is preferably set at 0.0005% by weight.

Ti, Nb, and V: 0.01% to 1.0% by weight in total

Titanium, niobium, and vanadium form carbides and are effective elements to increase the strength of the steel, and 0.01% to 1.0% by weight of at least one selected from the group consisting of the above elements is added. Although the effects described above can be obtained by the addition of 0.01% by weight or more in total of the above elements, if the content thereof exceeds 1.0% by weight, the cost is increased, and also the amounts of fine precipitates excessively increase, thus suppressing recovery and recrystallization after cold rolling, and also decreasing ductility (elongation). Therefore, the total amount of these elements to be added is set at 0.01% to 1.0% by weight, and preferably at 0.010% to 0.20% by weight.

Cu and Ni: 3.0% by weight or less in total

Copper and nickel form the second phase, such as martensite, thus being effective elements in increasing the strength of the steel, and are added as necessary. However, if the total content exceeds 3.0% by weight, the cost is increased, and also the yield point is decreased, which are disadvantageous when a high yield ratio is required. Therefore, the content of Cu and Ni in total is set in the range of 0.010 to 3.0% by weight. Since it is expensive to limit the content of each element to less than 0.005% by weight, the lower limit for each element is preferably set at 0.005% by weight.

Ca and REM: 0.001% to 0.10% by weight

Since calcium and REM control the forms of inclusions and sulfides and improve hole expandability, the content thereof is preferably set at 0.001% by weight or more. However, if the total content exceeds 0.1% by weight, the cost is increased. Therefore, the content of Ca and REM is preferably set in the range of 0.001% to 0.10% by weight or less, and more preferably, the total content is set in the range of 0.002% to 0.05% by weight.

Ferrite phase: 50% or more in areal rate

The present invention is directed to automotive steel sheets which require high workability, and if the areal rate of the ferrite phase is less than 50%, it is difficult to maintain necessary ductility and stretch-flanging properties. Additionally, when more satisfactory ductility is required, the ferrite percentage is preferably set at 75% or more in areal rate. Examples of ferrite also include bainitic ferrite and acicular ferrite which do not contain precipitates of carbides, in addition to so-called ferrite.

In order to observe and evaluate the ferrite phase, a steel sheet was embedded in a resin so that the cross section of the steel sheet was viewed, etching was performed by immersing it in a mixed solution of "an aqueous solution in which 1 g of sodium pyrosulfite was added to 100 ml of pure water" and "a solution in which 4 g of picric acid was added to 100 ml of ethanol" in the ratio of 1:1, at room temperature for 120 seconds, and the ferrite phase (black portion) and the second phase (white portion) were separated. The areal rate of ferrite was measured by an image analyzer with a magnifying power of 1,000.

Average Grain Diameter of Ferrite Phase: 10 $\mu$m (0.01 mm) or less

When heating is performed by annealing to the $\alpha+\gamma$ two-phase region, if the ferrite grain diameter exceeds 10 $\mu$m, the size of austenite grains generated from the ferrite grain boundaries increases by itself. Naturally, the large austenite grains are transformed into the second phase, such as martensite and bainite, during cooling, and causes cracking, resulting in a decrease in hole expandability. Therefore, in the present invention, in order to refine the second phase and improve hole expandability, the ferrite grain diameter is set at 10 $\mu$m or less.

Herein, the average grain diameter is determined by the value which is larger when compared between the value measured by planimetry according to ASTM based on a photograph of the sectional structure and the nominal grain diameter measured by a cutting method (for example, reported by Umemoto, et al. in "Thermal Treatment" 24 (1984) 334). Additionally, in the present invention, it is not necessary to particularly specify the types of the second phase (e.g., martensite, bainite, pearlite, and cementite).

Thickness of Band-like Structure: $Tb/T \leqq 0.005$

The band-like structure includes a group of second phases in which concentrated surface layers of C and Mn which cohere along grain boundaries mainly in the cooling process of the slab are rolled during hot rolling or during the subsequent cold rolling and are formed like a column or layer in the rolling direction and in the sheet width direction, in a steel having large amounts of C and Mn. The reason for setting the ratio Tb/T of the average thickness Tb of such a band-like structure to the thickness T of the steel sheet at 0.005 or less is that when a large amount of Mn is contained as in the present invention, the thickness of the band-like second phase structure containing C and Mn as principal ingredients is increased in the structure of the hot-rolled sheet, resulting in a difficulty in producing a high-strength steel sheet in which hard martensite is homogeneously dissolved in the ferrite matrix. Consequently, in order to efficiently produce a high-strength steel sheet, C and Mn which are concentrated in the band-like second phase must be dissolved, and the ratio of the average thickness Tb of the band-like structure and the thickness T of the sheet serves as a measure thereof. If the relationship $Tb/T \leqq 0.005$ is satisfied, good results can be obtained.

In order to observe and evaluate the thickness Tb of the band-like structure, a steel sheet was embedded in a resin so that the cross section of the steel sheet was viewed, etching was performed by immersing it in a 3% nital solution at room temperature for 15 seconds, and 20 pieces of column-like, layered structure of the second phase were measured by an image analyzer with a magnifying power of 1,500 to obtain the average thickness Tb.

Next, the production conditions in the present invention will be described.

A steel slab having the composition described above is hot-rolled by a conventional method, followed by coiling at 750 to 450° C. If the coiling temperature is less than 450° C., carbides, such as TiC and NbC, are not easily generated, resulting in a shortage in strength, and an internal oxidation layer is not easily formed just below the surface of the steel sheet, thus being unable to suppress the concentration of Mn in the surface of the steel sheet. On the other hand, if coiling is performed at a temperature exceeding 750° C., the thickness of a scale is increased and pickling efficiency is decreased, and also variations in material quality are increased among the tip, center, and rear end in the longitudinal direction of the coil, and the edge section and the center section in the coil width direction. Additionally, the coiling temperature is preferably set at 700 to 550° C.

The hot-rolled sheet is descaled by pickling treatment, as necessary, and as hot-rolled, or after cold-rolling is further performed, heating is performed at 750° C. or more by a continuous galvanizing line, followed by cooling, and then galvanizing is performed while cooling.

When double heating is performed, first, heating (first heating) is performed at 750° C. or more by a continuous annealing line or the like. Next, after cooling is performed, heating (second heating) is performed at 700° C. or more by a continuous galvanizing line, followed by cooling, and galvanizing is performed, preferably, at 420 to 600° C., while cooling.

By heating in the temperature range of 750° C. or more (preferably, 750 to 900° C.), followed by cooling, prior to galvanizing, Mn, etc., concentrated in the band-like structure are dissolved, and the complex structure including ferrite and martensite is efficiently formed, thus improving workability. That is, when the Mn content is increased as in the present invention, the band-like second phase is easily formed in the hot-rolled sheet, and the concentration of Mn, etc., in the γ phase is decreased, which is disadvantageous to the formation of the complex structure. Therefore, by decreasing the thickness of the band-like structure and by finely dissolving Mn, etc., when the temperature is maintained at approximately 500° C. in the galvanizing process in the continuous galvanizing line, or further in the galvannealing process, the Mn content concentrated in the γ phase is increased, and thus the martensite phase can be properly dissolved in the ferrite matrix.

When double heating is performed, the second heating is performed at 700° C. or more. The second heating is inevitably performed in the continuous galvanizing line. If the second heating temperature is less than 700° C., the surface of the steel sheet is not reduced, and galvanizing defects easily occur. The second heating temperature is preferably set in the range of 750 to 800° C. Additionally, when double heating is performed, pickling treatment is preferably performed in order to remove the concentrated surface layer of Mn, etc., generated in the first heating and to improve galvanizability thereafter. The pickling treatment is performed, preferably, at 30 to 70° C., in a 1 to 10% HCl solution, for approximately 3 to 10 s.

Subsequent to the heating process described above, galvanizing is performed, and in some cases, after galvanizing is performed, galvannealing may be performed successively.

EXAMPLE 1

Continuously cast slabs with a thickness of 300 mm having the chemical compositions shown in Table 1 were heated to 1,200° C., and were roughly rolled by 3-pass rolling, and then were hot-rolled by a 7-stand finishing rolling mill to form hot-rolled sheets with a thickness of 2.5 mm, followed by coiling. The hot-rolled sheets were subjected to pickling treatment, and as the hot-rolled sheets, or after the hot-rolled sheets were further cold-rolled to a thickness of 1.2 mm, galvanizing was performed in a process (1) including first heating in a continuous annealing line—pickling—second heating in a continuous galvanizing line, or a process (2) including heating in a continuous galvanizing line—galvanizing. Furthermore, with respect to samples collected from portions thereof, galvannealing was performed. The production conditions for the above are shown in Table 2.

Additionally, as the CGL conditions after heating, the average cooling rate for the steel sheets from heating to galvanizing was set at 10° C./s, immersion in a galvanizing bath with the conditions described below was performed, and then the areal weight was adjusted to 60 g/m$^2$ by gas-wiping. Next, heating was performed to 490° C., followed by holding for 20 s, and then cooling was performed to 200° C. or less at an average cooling rate of 20° C./s.

Composition: 0.15% Al—Zn

Temperature: 470° C.

Immersion time: 1 s

With the resulting steel sheets being treated as samples, mechanical characteristics, galvanizability, spot weldability, etc., were investigated. The results thereof are shown in Table 2.

Herein, mechanical characteristics, galvanizability, galvannealability, and spot weldability were evaluated by the methods described below.

Mechanical characteristics (investigated by tensile test and hole expanding test)

Using No. 5 test pieces according to JIS Z 2204 collected from the steel sheets in a direction at right angles to the rolling direction, yield strength (YS), tensile strength (TS), elongation at break (El), and yield elongation (YEl) were measured according to JIS Z 2241.

In order to investigate stretch-flanging properties, the hole expanding rate (λ) was measured by a hole expanding test according to JFS T 1001.

Galvanizability

Good: No non-galvanized defects

Partially Good: Non-galvanized defects occurred in some parts

Bad: Many non-galvanized defects occurred

Galvannealability

Good: Completely free from galvannealing blurs

Partially Good: Galvannealing blurs slightly observed

Bad: Galvannealing blurs significantly observed

Spot Weldability

Spot welding was performed under the following welding conditions. That is, a welding electrode with a dome tip diameter of 6 Φ was used with an electrode force of 3.10 kN, a welding current of 7 kA, a squeeze time of 25 cyc., a setup time of 3 cyc., a welding time of 13 cyc., and a holding time of 25 cyc. A tensile load by a tensile shear test according to JIS Z 3136 (TSS) and a tensile load by a cross tensile test according to JIS Z 3137 (CTS) were applied, and the test pieces in which the tensile shear loads were 8,787 N or more corresponding to the standard tensile shear load at a sheet thickness of 1.2 mm, and in which the ductility ratio (CTS/TSS) is 0.25 or more were evaluated as "superior", and the test pieces which did not satisfy the above values were evaluated as "inferior".

As is clear from Tables 1 and 2, in the examples of the present invention, tensile properties with a TS of 590 to 690 MPa and an El of 25% by weight or more are observed, and satisfactory TS×El balances with 15,000 MPa.wt % or more are observed, and also there is no particular problems with respect to galvanizability, galvannealability, and spot weldability.

EXAMPLE 2

Continuously cast slabs with a thickness of 300 mm having the chemical compositions shown in Table 3 were heated to 1,200° C., and were roughly rolled by 3-pass rolling, and were then hot-rolled by a 7-stand finishing rolling mill to form hot-rolled sheets with a thickness of 3.0 mm, followed by coiling at temperatures shown in Table 4. The hot-rolled sheets were subjected to pickling treatment, and as the hot-rolled sheets, or after the hot-rolled sheets were further cold-rolled to a thickness of 1.2 mm, galvanizing was performed in a process (1) including first heating in a continuous annealing line—pickling—second heating in a continuous galvanizing line, or a process (2) including heating in a continuous galvanizing line—galvanizing. Furthermore, with respect to samples collected from portions thereof, galvannealing was performed. The production conditions for the above are shown in Table 4.

Galvanizing was performed in a process (1) including first heating in a continuous annealing line—pickling—second heating in a continuous galvanizing line, or a process (2) including heating in a continuous galvanizing line—galvanizing. Furthermore, with respect to some portions thereof, galvannealing was performed. The production conditions for the above are shown in Table 4.

With the resulting steel sheets being treated as samples, mechanical characteristics, galvanizability, spot weldability, etc., were evaluated in a similar manner. The results thereof are also shown in Table 4.

Additionally, as the CGL conditions after heating, the average cooling rate for the steel sheets from heating to galvanizing was set at 10° C./s, immersion in a galvanizing bath with the conditions described below was performed, and then the areal weight was adjusted to 60 g/m$^2$ by gas-wiping. Next, heating was performed to 490° C., followed by holding for 20 s, and then cooling was performed to 200° C. or less at an average cooling rate of 20° C./s.

Composition: 0.15% Al—Zn

Temperature: 470° C.

Immersion time: 1 s

Areal weight: 60 g/m$^2$

As a result, it has been found that, in the examples of the present invention, the TS×El balances are satisfactory, and although high strength is obtained, there are no problems with respect to galvanizability, galvannealability, and spot weldability.

EXAMPLE 3

Continuously cast slabs with a thickness of 300 mm having the chemical compositions shown in Table 5 were heated to 1,200° C., and were roughly rolled by 3-pass rolling, and were then hot-rolled by a 7-stand finishing rolling mill to form hot-rolled sheets with a thickness of 3.0 mm, followed by coiling at temperatures shown in Table 6. After pickling treatment was performed, the sheets were cold-rolled to a thickness of 1.2 mm, and galvanizing was performed in a process including first heating in a continuous annealing line—pickling—second heating in a continuous galvanizing line, and then galvannealing was performed. The production conditions for the above are shown in Table 6.

With the resulting steel sheets being treated as samples, mechanical characteristics, galvanizability, spot weldability, etc., were evaluated in a similar manner. The results thereof are also shown in Table 6.

Additionally, as the CGL conditions after heating, the average cooling rate for the steel sheets from heating to galvanizing was set at 10° C./s, immersion in a galvanizing bath with the conditions described below was performed, and then the areal weight was adjusted to 60 g/m$^2$ by gas-wiping. Next, heating was performed to 490° C., followed by holding for 20 s, and then cooling was performed to 200° C. or less at an average cooling rate of 20° C./s.

Composition: 0.15% Al—Zn

Temperature: 470° C.

Immersion time: 1 s

Areal weight: 60 g/m$^2$

As a result, it has been found that, in the examples of the present invention, the TS×El balances are satisfactory, and although high strength is obtained, there are no problems with respect to galvanizability, galvannealability, and spot weldability.

INDUSTRIAL APPLICABILITY

As described above, in accordance with the present invention, it is possible to provide a hot-dip galvanized high-strength steel sheet in which satisfactory galvanizability is obtained, the yield ratio is decreased, the TS×El balance is satisfactory. Therefore, the present invention can reduce weight and improve gas mileage in automobiles, thus greatly contributing to improvement in the global environment.

TABLE 1

| Steel | C | Si | Mn | P | S | Al | N | Ti | Nb | V | Remarks |
|---|---|---|---|---|---|---|---|---|---|---|---|
| A | 0.075 | 0.01 | 2.4 | 0.007 | 0.003 | 0.05 | 0.0022 | 0.02 | 0.05 | — | Applicable steel |
| B | 0.101 | 0.02 | 2.3 | 0.009 | 0.002 | 0.01 | 0.0032 | 0.21 | 0.03 | — | Applicable steel |
| C | 0.056 | 0.02 | 2.2 | 0.012 | 0.001 | 0.05 | 0.0025 | 0.01 | 0.03 | 0.03 | Applicable steel |
| D | 0.068 | 0.01 | 1.6 | 0.011 | 0.001 | 0.07 | 0.0033 | 0.06 | — | — | Applicable steel |
| E | 0.098 | 0.04 | 1.8 | 0.012 | 0.002 | 0.06 | 0.0026 | — | 0.07 | — | Applicable steel |
| F | 0.051 | 0.01 | 1.7 | 0.012 | 0.001 | 0.04 | 0.0031 | 0.01 | — | 0.05 | Applicable steel |
| G | 0.084 | 0.01 | 1.6 | 0.008 | 0.001 | 0.02 | 0.0026 | 0.06 | 0.02 | 0.03 | Applicable steel |
| H | 0.064 | 0.02 | 1.5 | 0.009 | 0.002 | 0.03 | 0.0025 | 0.02 | 0.04 | — | Applicable steel |
| I | 0.039 | 0.02 | 1.6 | 0.005 | 0.003 | 0.04 | 0.0021 | 0.05 | 0.05 | — | Applicable steel |
| J | 0.163 | 0.03 | 1.6 | 0.016 | 0.002 | 0.05 | 0.0029 | 0.09 | 0.03 | 0.02 | Applicable steel |
| K | 0.022 | 0.01 | 2.6 | 0.008 | 0.002 | 0.04 | 0.0027 | 0.07 | 0.01 | — | Applicable steel |
| L | 0.074 | 0.01 | 1.7 | 0.01 | 0.001 | 0.04 | 0.0028 | — | — | — | Comparative steel |
| M | 0.007 | 0.02 | 1.8 | 0.009 | 0.002 | 0.04 | 0.0021 | 0.025 | — | — | Comparative steel |
| N | 0.082 | 0.02 | 0.7 | 0.026 | 0.002 | 0.03 | 0.0028 | 0.016 | — | — | Comparative steel |
| O | 0.095 | 0.05 | 1.7 | 0.113 | 0.004 | 0.06 | 0.0032 | 0.033 | — | — | Comparative steel |

TABLE 2

| No. | Steel | CT ° C. | Cold rolling | First heating temperature ° C. | Second heating temperature ° C. | Areal rate of ferrite grains % | Average grain diameter μm | Tb/T | YS MPa | TS MPa | EL % | YEL % |
|---|---|---|---|---|---|---|---|---|---|---|---|---|
| 1 | A | 640 | Not performed | 800 | 750 | 80 | 3.5 | 0.003 | 389 | 595 | 30 | 0.0 |
| 2 | A | 680 | Performed | 770 | — | 76 | 3.1 | 0.004 | 402 | 631 | 29 | 0.0 |
| 3 | B | 640 | Performed | 850 | 720 | 70 | 2.3 | 0.002 | 396 | 645 | 30 | 0.0 |
| 4 | B | 650 | Performed | 725 | 700 | 30 | 2.1 | 0.008 | 850 | 951 | 11 | 0.0 |
| 5 | B | 550 | Performed | 840 | — | 76 | 1.9 | 0.002 | 411 | 653 | 29 | 0.0 |
| 6 | C | 530 | Performed | 850 | 800 | 85 | 4.2 | 0.002 | 362 | 595 | 32 | 0.0 |
| 7 | C | 400 | Performed | 850 | 775 | 82 | 3.5 | 0.003 | 396 | 624 | 26 | 0.0 |
| 8 | D | 670 | Performed | 850 | 750 | 83 | 2.7 | 0.002 | 441 | 651 | 27 | 0.0 |
| 9 | D | 570 | Not performed | 700 | 850 | 80 | 3.6 | 0.003 | 458 | 668 | 26 | 0.0 |
| 10 | D | 570 | Performed | 800 | — | 78 | 2.8 | 0.004 | 448 | 631 | 27 | 0.0 |
| 11 | E | 620 | Not performed | 775 | 730 | 76 | 3.3 | 0.004 | 432 | 596 | 28 | 0.0 |
| 12 | E | 620 | Not performed | 775 | — | 75 | 3.5 | 0.004 | 441 | 608 | 25 | 0.0 |
| 13 | E | 620 | Performed | 700 | 800 | 70 | 3.0 | 0.004 | 499 | 697 | 24 | 0.0 |
| 14 | F | 630 | Performed | 840 | 750 | 82 | 3.5 | 0.002 | 388 | 598 | 30 | 0.0 |
| 15 | F | 620 | Performed | 800 | — | 80 | 3.2 | 0.003 | 463 | 613 | 25 | 0.0 |
| 16 | F | 400 | Performed | 850 | 750 | 78 | 2.8 | 0.002 | 467 | 633 | 24 | 0.0 |
| 17 | F | 500 | Not performed | 750 | 690 | 55 | 2.2 | 0.010 | 608 | 768 | 18 | 0.0 |
| 18 | G | 640 | Performed | 840 | 775 | 80 | 3.6 | 0.003 | 443 | 634 | 26 | 0.0 |
| 19 | G | 640 | Not performed | 850 | 800 | 82 | 3.8 | 0.003 | 443 | 624 | 30 | 0.0 |
| 20 | G | 640 | Not performed | 830 | 750 | 78 | 3.4 | 0.004 | 440 | 612 | 25 | 0.0 |
| 21 | H | 530 | Performed | 840 | 800 | 85 | 4.1 | 0.002 | 448 | 633 | 24 | 0.0 |
| 22 | H | 620 | Performed | 850 | 725 | 83 | 3.4 | 0.002 | 453 | 653 | 23 | 0.0 |
| 23 | I | 700 | Performed | 820 | 750 | 90 | 8.2 | 0.003 | 403 | 595 | 30 | 0.0 |
| 24 | I | 650 | Performed | 850 | 730 | 87 | 7.4 | 0.002 | 401 | 608 | 31 | 0.0 |
| 25 | J | 600 | Performed | 775 | 750 | 64 | 1.9 | 0.00S | 402 | 630 | 26 | &.0 |
| 26 | K | 620 | Performed | 850 | 750 | 92 | 9.8 | 0.002 | 432 | 610 | 30 | 0.0 |
| 27 | L | 650 | Performed | 880 | 730 | 86 | 11.0 | 0.002 | 489 | 550 | 28 | 2.2 |
| 28 | M | 700 | Not performed | 825 | 700 | 97 | 15.0 | 0.001 | 305 | 496 | 33 | 0.8 |
| 29 | N | 650 | Not performed | 850 | 650 | 92 | 12.0 | 0.001 | 260 | 470 | 35 | 1.5 |
| 30 | O | 700 | Not performed | 730 | 750 | 35 | 7.0 | 0.007 | 602 | 762 | 19 | 0.8 |

| No. | YR % | TS × El MPa % | Galvanizability | Galvannealability | Hole expandability λ % | Spot weldability | Remarks |
|---|---|---|---|---|---|---|---|
| 1 | 65 | 17850 | Good | Good | 81 | Superior | Example of present invention |
| 2 | 64 | 18299 | Partially Good | Partially Good | 89 | Superior | Example of present invention |
| 3 | 61 | 19350 | Good | Good | 90 | Superior | Example of present invention |
| 4 | 89 | 10461 | Bad | Bad | 22 | Superior | Comparative Example |
| 5 | 63 | 18937 | Partially Good | Partially Good | 95 | Superior | Example of present invention |
| 6 | 61 | 19040 | Good | Good | 92 | Superior | Example of present invention |
| 7 | 63 | 16224 | Bad | Bad | 90 | Superior | Comparative Example |
| 8 | 68 | 17577 | Good | Good | 99 | Superior | Example of present invention |
| 9 | 69 | 17368 | Bad | Bad | 84 | Superior | Comparative Example |
| 10 | 71 | 17037 | Partially Good | Partially Good | 95 | Superior | Example of present invention |
| 11 | 72 | 16688 | Good | Good | 83 | Superior | Example of present invention |
| 12 | 73 | 15200 | Partially Good | Partially Good | 81 | Superior | Example of present invention |
| 13 | 72 | 16728 | Bad | Bad | 92 | Superior | Comparative Example |
| 14 | 65 | 17940 | Good | Good | 101 | Superior | Example of present invention |
| 15 | 76 | 15325 | Partially Good | Partially Good | 105 | Superior | Example of present invention |
| 16 | 74 | 15192 | Bad | Bad | 110 | Superior | Comparative Example |
| 17 | 79 | 13824 | Bad | Bad | 41 | Superior | Comparative Example |
| 18 | 70 | 16484 | Good | Good | 92 | Superior | Example of present invention |
| 19 | 71 | 18720 | Good | Good | 86 | Superior | Example of present invention |
| 20 | 72 | 15300 | Good | Good | 93 | Superior | Example of present invention |
| 21 | 71 | 15192 | Good | Good | 83 | Superior | Example of present invention |
| 22 | 69 | 15019 | Good | Good | 91 | Superior | Example of present invention |
| 23 | 68 | 17850 | Good | Good | 112 | Superior | Example of present invention |
| 24 | 66 | 18848 | Good | Good | 118 | Superior | Example of present invention |
| 25 | 64 | 16380 | Good | Good | 86 | Superior | Example of present invention |
| 26 | 71 | 18300 | Good | Good | 103 | Superior | Example of present invention |
| 27 | 89 | 15400 | Good | Good | 53 | Superior | Comparative Example |
| 28 | 61 | 16368 | Good | Good | 72 | Superior | Comparative Example |
| 29 | 55 | 16450 | Bad | Bad | 68 | Superior | Comparative Example |
| 30 | 79 | 14478 | Bad | Bad | 37 | Inferior | Comparative Example |

TABLE 3

| Steel | C | Si | Mn | P | S | Al | N | Ti | Nb | V | Cu | Ni | Ca | REM | Remarks |
|---|---|---|---|---|---|---|---|---|---|---|---|---|---|---|---|
| P | 0.097 | 0.01 | 1.8 | 0.005 | 0.001 | 0.08 | 0.0033 | 0.02 | 0.06 | 0 | 0.5 | 0.3 | 0 | 0.01 | Applicable steel |
| Q | 0.075 | 0.02 | 1.9 | 0.008 | 0.001 | 0.04 | 0.0030 | 0.02 | 0.11 | 0 | 1.2 | 0.8 | 0 | 0 | Applicable steel |
| R | 0.056 | 0.09 | 2.5 | 0.009 | 0.001 | 0.05 | 0.0025 | 0.01 | 0.09 | 0 | 0.9 | 0 | 0.003 | 0 | Applicable steel |
| S | 0.062 | 0.05 | 1.6 | 0.007 | 0.001 | 0.06 | 0.0033 | — | 0.07 | 0.03 | 1.2 | 0.8 | 0 | 0 | Applicable steel |
| T | 0.092 | 0.04 | 3.2 | 0.012 | 0.002 | 0.06 | 0.0026 | 0.05 | 0.09 | 0.02 | 0 | 0 | 0.002 | 0 | Comparative steel |
| U | 0.181 | 0.9 | 1.8 | 0.008 | 0.001 | 0.04 | 0.0031 | 0.01 | 0.11 | 0.02 | 0 | 0 | 0.003 | 0 | Applicable steel |
| V | 0.225 | 0.01 | 2.3 | 0.025 | 0.001 | 0.03 | 0.0028 | 0 | 0.02 | 0 | 0 | 0 | 0 | 0 | Comparative steel |
| W | 0.061 | 0.01 | 1.9 | 0.009 | 0.001 | 0.08 | 0.0033 | 0.15 | 0.04 | 0 | 0 | 0 | 0 | 0 | Applicable steel |
| X | 0.081 | 0.01 | 1.9 | 0.008 | 0.001 | 0.04 | 0.0030 | 0.02 | 0.11 | 0 | 0.5 | 0 | 0 | 0 | Applicable steel |
| Y | 0.044 | 0.01 | 2.6 | 0.018 | 0.001 | 0.05 | 0.0025 | 0.01 | 0.14 | 0 | 0.5 | 0 | 0 | 0 | Applicable steel |
| Z | 0.074 | 0.01 | 1.8 | 0.007 | 0.001 | 0.06 | 0.0033 | — | 0.07 | 0.03 | 0.5 | 0.3 | 0 | 0 | Applicable steel |

TABLE 4

| No. | Steel | CT ° C. | Cold rolling | First heating temperature ° C. | Second heating temperature ° C. | Areal rate of ferrite grains % | Average grain diameter μm | Tb/T | YS MPa | TS MPa | EL % | YEL % |
|---|---|---|---|---|---|---|---|---|---|---|---|---|
| 31 | P | 550 | Not performed | 850 | 750 | 80 | 2.1 | 0.003 | 596 | 812 | 20 | 0.0 |
| 32 | P | 550 | Performed | 850 | 750 | 80 | 1.9 | 0.003 | 622 | 885 | 17 | 0.0 |
| 33 | Q | 550 | Performed | 850 | 725 | 78 | 1.8 | 0.003 | 618 | 815 | 20 | 0.0 |
| 34 | Q | 350 | Performed | 850 | 750 | 77 | 1.7 | 0.003 | 713 | 855 | 15 | 0.0 |
| 35 | R | 550 | Performed | 850 | 750 | 80 | 2.3 | 0.004 | 511 | 782 | 22 | 0.0 |
| 36 | R | 550 | Performed | 850 | 800 | 81 | 2.1 | 0.003 | 498 | 803 | 24 | 0.0 |
| 37 | S | 550 | Performed | 850 | 750 | 82 | 2.2 | 0.002 | 553 | 846 | 18 | 0.0 |
| 38 | S | 550 | Performed | — | 730 | * | * | 0.015 | 789 | 869 | 5 | 0.0 |
| 39 | T | 550 | Performed | 850 | 750 | 65 | 1.6 | 0.005 | 458 | 668 | 26 | 0.0 |
| 40 | U | 550 | Performed | 850 | 750 | 55 | 1.5 | 0.001 | 624 | 812 | 26 | 0.0 |
| 41 | U | 550 | Not performed | 850 | 750 | 58 | 1.7 | 0.001 | 604 | 806 | 28 | 0.0 |
| 42 | V | 550 | Not performed | 850 | 750 | 47 | 1.5 | 0.003 | 701 | 932 | 10 | 0.0 |
| 43 | W | 550 | Performed | 850 | 750 | 80 | 2.4 | 0.003 | 489 | 677 | 24 | 0.0 |
| 44 | W | 550 | Performed | 850 | 750 | 78 | 2.1 | 0.003 | 468 | 639 | 30 | 0.0 |
| 45 | X | 550 | Performed | 850 | 750 | 82 | 2.7 | 0.003 | 533 | 723 | 22 | 0.0 |
| 46 | Y | 550 | Performed | 850 | 775 | 88 | 5.2 | 0.002 | 481 | 633 | 26 | 0.0 |
| 47 | Z | 550 | Not performed | 850 | 750 | 81 | 2.4 | 0.003 | 499 | 674 | 24 | 0.0 |
| 48 | Z | 550 | Performed | — | 800 | 83 | 1.9 | 0.004 | 510 | 711 | 22 | 0.0 |

| No. | YR % | TS × El MPa % | Galvanizability | Galvannealability | Hole expandability λ % | Spot weldability | Remarks |
|---|---|---|---|---|---|---|---|
| 31 | 73 | 16240 | Good | Good | 83 | Superior | Example of present invention |
| 32 | 70 | 15045 | Good | Good | 87 | Superior | Example of present invention |
| 33 | 76 | 16300 | Good | Good | 92 | Superior | Example of present invention |
| 34 | 83 | 12825 | Bad | Bad | 93 | Superior | Comparative Example |
| 35 | 65 | 17204 | Good | Good | 102 | Superior | Example of present invention |
| 36 | 62 | 19272 | Good | Good | 105 | Superior | Example of present invention |
| 37 | 65 | 15228 | Good | Good | 86 | Superior | Example of present invention |
| 38 | 91 | 4345 | Good | Good | 10 | Superior | Comparative Example |
| 39 | 69 | 17368 | Bad | Bad | 43 | Inferior | Comparative Example |
| 40 | 77 | 21112 | Good | Good | 88 | Superior | Example of present invention |
| 41 | 75 | 22568 | Good | Good | 85 | Superior | Example of present invention |
| 42 | 75 | 9320 | Good | Good | 15 | Inferior | Comparative Example |
| 43 | 72 | 16248 | Good | Good | 88 | Superior | Example of present invention |
| 44 | 73 | 19170 | Good | Good | 91 | Superior | Example of present invention |
| 45 | 74 | 15906 | Good | Good | 86 | Superior | Example of present invention |
| 46 | 76 | 16458 | Good | Good | 80 | Superior | Example of present invention |
| 47 | 74 | 16176 | Good | Good | 86 | Superior | Example of present invention |
| 48 | 72 | 15642 | Good | Good | 89 | Superior | Example of present invention |

* Unable to measure due to unrecrystallization

TABLE 5

| Steel | C | Si | Mn | P | S | Al | N | Ti | Nb | V | Cu | Ni | Ca | REM | Remarks |
|---|---|---|---|---|---|---|---|---|---|---|---|---|---|---|---|
| a | 0.062 | 0.25 | 2.9 | 0.007 | 0.001 | 0.042 | 0.0074 | 0.128 | 0.066 | 0 | 0.05 | 0.02 | 0 | 0 | Applicable steel |
| b | 0.071 | 0.03 | 2.7 | 0.009 | 0.001 | 0.035 | 0.0026 | 0.023 | 0.09 | 0 | 0.01 | 0.01 | 0 | 0.01 | Applicable steel |
| c | 0.012 | 0.35 | 2.3 | 0.006 | 0.011 | 0.045 | 0.0032 | 0.105 | 0.06 | 0 | 0.02 | 0.02 | 0.003 | 0.002 | Applicable steel |
| d | 0.122 | 0.05 | 3.3 | 0.007 | 0.001 | 0.026 | 0.0024 | — | 0.07 | 0.03 | 0.95 | 0.31 | 0 | 0 | Applicable steel |
| e | 0.092 | 1.12 | 2.7 | 0.009 | 0.001 | 0.052 | 0.0056 | 0.05 | 0.09 | 0.02 | 0 | 0 | 0.002 | 0 | Comparative steel |
| f | 0.205 | 0.02 | 2.7 | 0.007 | 0.001 | 0.042 | 0.0029 | 0.08 | 0.08 | 0.02 | 0 | 0 | 0.003 | 0 | Comparative steel |

TABLE 5-continued

| Steel | C | Si | Mn | P | S | Al | N | Ti | Nb | V | Cu | Ni | Ca | REM | Remarks |
|---|---|---|---|---|---|---|---|---|---|---|---|---|---|---|---|
| g | 0.195 | 0.01 | 2.3 | 0.113 | 0.001 | 0.033 | 0.0028 | — | 0.02 | 0 | 0 | 0 | 0 | 0 | Comparative steel |
| h | 0.084 | 0.03 | 2.8 | 0.011 | 0.052 | 0.012 | 0.0029 | 0.15 | 0.04 | 0 | 0 | 0 | 0 | 0 | Comparative steel |
| i | 0.081 | 0.01 | 3.0 | 0.015 | 0.001 | 0.041 | 0.0067 | — | — | 0 | 0.3 | 0.15 | 0 | 0 | Comparative steel |
| j | 0.077 | 0.02 | 2.7 | 0.018 | 0.001 | 0.033 | 0.0025 | 0.003 | 0.005 | 0 | 0.5 | 0 | 0 | 0 | Comparative steel |
| k | 0.008 | 0.01 | 1.6 | 0.023 | 0.001 | 0.055 | 0.0033 | — | 0.07 | 0.03 | 0.5 | 0.3 | 0 | 0 | Comparative steel |
| l | 0.066 | 0.05 | 1.7 | 0.007 | 0.001 | 0.038 | 0.0069 | 0.028 | 0.071 | 0 | 1.9 | 1.2 | 0 | 0 | Comparative steel |
| m | 0.063 | 0.02 | 2.9 | 0.008 | 0.0o1 | 0.036 | 0.0032 | 0.023 | 0.066 | 0 | 2.2 | 0.9 | 0 | 0.02 | Comparative steel |

TABLE 6

| No. | Steel | CT ° C. | Cold rolling | First heating temperature ° C. | Second heating temperature ° C. | Areal rate of ferrite grains % | Average grain diameter μm | Tb/T | YS MPa | TS MPa | EL % | YEL % |
|---|---|---|---|---|---|---|---|---|---|---|---|---|
| 49 | a | 700 | Performed | 850 | 750 | 65 | 1.9 | 0.004 | 596 | 993 | 17 | 0.0 |
| 50 | a | 400 | Performed | 850 | 750 | 66 | 1.8 | 0.004 | 602 | 1022 | 16 | 0.0 |
| 51 | b | 700 | Performed | 850 | 750 | 59 | 1.8 | 0.004 | 618 | 983 | 18 | 0.0 |
| 52 | b | 700 | Performed | 850 | 680 | 57 | 1.8 | 0.003 | 602 | 893 | 18 | 0.0 |
| 53 | c | 700 | Performed | 850 | 750 | 63 | 2.0 | 0.004 | 511 | 812 | 19 | 0.0 |
| 54 | d | 700 | Performed | 850 | 750 | 56 | 2.2 | 0.011 | 553 | 1020 | 12 | 0.0 |
| 55 | e | 700 | Performed | 850 | 750 | 56 | 2.1 | 0.005 | 458 | 668 | 16 | 0.0 |
| 56 | f | 700 | Performed | 850 | 750 | 47 | 1.5 | 0.006 | 624 | 812 | 15 | 0.0 |
| 57 | g | 700 | Performed | 850 | 750 | 63 | 1.5 | 0.003 | 701 | 932 | 15 | 0.0 |
| 58 | h | 700 | Performed | 850 | 750 | 64 | 2.4 | 0.003 | 735 | 1025 | 12 | 0.0 |
| 59 | i | 700 | Performed | 850 | 750 | 52 | 2.5 | 0.004 | 533 | 853 | 17 | 0.0 |
| 60 | j | 700 | Performed | 700 | 750 | 61 | 2.3 | 0.003 | 480 | 987 | 15 | 0.0 |
| 61 | k | 700 | Performed | 850 | 750 | 99 | 18.0 | 0.001 | 322 | 381 | 38 | 0.0 |
| 62 | l | 700 | Performed | 850 | 750 | 81 | 2.7 | 0.002 | 542 | 826 | 18 | 0.0 |
| 63 | m | 700 | Performed | 850 | 750 | 78 | 2.4 | 0.003 | 689 | 996 | 15 | 0.0 |

| No. | YR % | TS × El MPa % | Galvanizability | Galvannealability | Hole expandability λ % | Spot weldability | Remarks |
|---|---|---|---|---|---|---|---|
| 49 | 60 | 16881 | Good | Good | 36 | Superior | Example of present invention |
| 50 | 59 | 16352 | Bad | Bad | 33 | Superior | Comparative Example |
| 51 | 63 | 17694 | Good | Good | 42 | Superior | Example of present invention |
| 52 | 67 | 16074 | Bad | Bad | 45 | Superior | Comparative Example |
| 53 | 63 | 15428 | Good | Good | 38 | Superior | Example of present invention |
| 54 | 54 | 12240 | Good | Good | 24 | Inferior | Comparative Example |
| 55 | 69 | 10688 | Bad | Bad | 32 | Inferior | Comparative Example |
| 56 | 77 | 12180 | Good | Good | 14 | Inferior | Comparative Example |
| 57 | 75 | 13980 | Good | Good | 12 | Inferior | Comparative Example |
| 58 | 72 | 12300 | Good | Good | 10 | Inferior | Comparative Example |
| 59 | 62 | 14501 | Good | Good | 42 | Inferior | Comparative Example |
| 60 | 49 | 14805 | Good | Good | 40 | Inferior | Comparative Example |
| 61 | 85 | 14478 | Good | Good | 82 | Superior | Comparative Example |
| 62 | 66 | 14868 | Bad | Bad | 35 | Superior | Comparative Example |
| 63 | 69 | 14940 | Good | Good | 36 | Inferior | Comparative Example |

What is claimed is:

1. A method for producing a hot-dip galvanized high-strength steel sheet having superior workability and galvanizability, wherein the steel sheet has a metal structure in which the areal rate of a ferrite phase is 50% or more, the ferrite phase has an average grain diameter of 10 μm or less, and the thickness of a band structure comprising a second phase satisfies the relationship $Tb/T \leqq 0.005$, where Tb is the average thickness in the sheet thickness direction of the band structure and T is the thickness of the steel sheet, the method comprising the steps of:

hot-rolling a slab comprising:

0.01% to 0.20% by weight of C;

1.0% by weight or less of Si;

more than 1.5% to 3.0% by weight of Mn;

0.10 by weight or less of P;

0.05% by weight or less of S;

0.10% by weight or less of Al;

0.010% by weight or less of N;

0.010% to 1.0% by weight in total of at least one element selected from the group consisting of Ti, Nb, and V; and the balance being Fe and incidental impurities;

coiling the hot-rolled sheet at 750 to 450° C.;

performing, optionally, cold-rolling;

heating the resulting hot-rolled sheet or cold-rolled sheet to 750° C. or more;

cooling and then heating the sheet to a temperature of 700° C. or more; and subjecting the sheet to hot-dip galvanizing during a cooling step from this temperature.

2. A method for producing a hot-dip galvanized high-strength steel sheet having superior workability and galvanizability according to claim 1, wherein the slab further comprises 3.0% by weight or less in total of at least one of Cu and Ni.

3. A method for producing a hot-dip galvanized high-strength steel sheet having superior workability and galvanizability according to claim 1, wherein the slab further comprises 0.001% to 0.10% by weight or less in total of at least one of Ca and REM.

4. A method for producing a hot-dip galvanized high-strength steel sheet having superior workability and galvanizability according to claim 2, wherein the method further comprises the step of galvannealing the sheet.

* * * * *